US010220439B2

(12) United States Patent
Akiyama et al.

(10) Patent No.: US 10,220,439 B2
(45) Date of Patent: Mar. 5, 2019

(54) CASTING MOLD SUPPORTING STRUCTURE, CASTING MACHINE, METHOD FOR PRODUCING CAST PRODUCT, CASTING MOLD, AND MOLTEN METAL SUPPLYING STRUCTURE

(71) Applicant: Kubota Corporation, Osaka (JP)

(72) Inventors: Naohisa Akiyama, Hyogo (JP); Masaru Kohara, Hyogo (JP); Shinichiro Tanaka, Hyogo (JP)

(73) Assignee: KUBOTA CORPORATION, Osaka (JP)

( * ) Notice: Subject to any disclaimer, the term of this patent is extended or adjusted under 35 U.S.C. 154(b) by 233 days.

(21) Appl. No.: 15/004,201

(22) Filed: Jan. 22, 2016

(65) Prior Publication Data

US 2016/0214167 A1 Jul. 28, 2016

(30) Foreign Application Priority Data

Jan. 23, 2015 (JP) ..... 2015-011640
Jan. 23, 2015 (JP) ..... 2015-011642

(51) Int. Cl.
*B22D 13/10* (2006.01)
*B22D 41/04* (2006.01)
*F27D 3/14* (2006.01)

(52) U.S. Cl.
CPC ..... *B22D 13/101* (2013.01); *B22D 13/107* (2013.01); *B22D 41/04* (2013.01); *F27D 3/14* (2013.01)

(58) Field of Classification Search
CPC .... B22D 13/107; B22D 39/026; B22D 41/04; B22D 41/05
USPC ..... 164/336
See application file for complete search history.

(56) References Cited

U.S. PATENT DOCUMENTS 1,624,553 A * 4/1927 Koegle ..... B22D 41/04 222/166
3,398,782 A * 8/1968 Lauterjung ..... B22D 39/026 164/156.1
4,632,172 A * 12/1986 Etienne ..... B22D 13/12 164/114

FOREIGN PATENT DOCUMENTS

| | | |
|---|---|---|
| CA | 1048276 A | 2/1979 |
| FR | 593957 A | 9/1925 |
| FR | 627240 A | 9/1927 |
| GB | 1489837 A | 10/1977 |
| JP | 50-140134 | 11/1975 |
| JP | 50-148229 | 11/1975 |

(Continued)

OTHER PUBLICATIONS

Japanese Office Action dated Nov. 4, 2015 issued in Japanese Patent Application No. 2015-011640 with Full English Translation.

(Continued)

*Primary Examiner* — Kevin E Yoon
(74) *Attorney, Agent, or Firm* — Harness, Dickey and Pierce, P.L.C.

(57) ABSTRACT

A casting mold supporting structure is provided herein which includes a support roller for supporting a part of a casting mold that is used in centrifugal casting. The casting mold has a supported surface (that is, a side surface of an end portion of the casting mold which end portion has a circular truncated cone shape) at which the casting mold is supported by the support roller. The supported surface is inclined with respect to a rotation axis of the casting mold.

7 Claims, 16 Drawing Sheets

(56) References Cited

FOREIGN PATENT DOCUMENTS

| | | | |
|---|---|---|---|
| JP | 07-204819 | A | 8/1995 |
| JP | 2006-326645 | A | 12/2006 |
| JP | 2006-326646 | A | 12/2006 |
| JP | 2011-212688 | A | 10/2011 |

OTHER PUBLICATIONS

Japanese Office Action dated Nov. 10, 2015 issued in Japanese Patent Application No. 2015-011642 with Full English Translation.
Japanese Office Action dated Nov. 8, 2016 issued in Japanese Patent Application No. 2016-002272.

* cited by examiner

PRIOR ART

CASTING MOLD SUPPORTING STRUCTURE, CASTING MACHINE, METHOD FOR PRODUCING CAST PRODUCT, CASTING MOLD, AND MOLTEN METAL SUPPLYING STRUCTURE

PRIORITY STATEMENT

This United States non-provisional patent application claims priority under 35 U.S.C. § 119 to Patent Applications No. 2015-011640 and No. 2015-011642 filed in Japan on Jan. 23, 2015, the entire contents of which are hereby incorporated by reference.

TECHNICAL FIELD

The present invention relates to (i) a casting mold supporting structure, (ii) a casting machine, (iii) a method for producing a cast product, (iv) a casting mold, and (v) a molten metal supplying structure including a ladle from which molten metal is supplied to an outside, which are used in centrifugal casting.

BACKGROUND ART

As a structure for supporting a rotating casting mold in a centrifugal casting machine during centrifugal casting, for example, Patent Literature 1 discloses a casting machine which includes two bearing devices respectively provided in front and back of a casting mold in an axis direction of the casting mold.

CITATION LIST

Patent Literature

[Patent Literature 1]
Japanese Patent Application Publication Tokukai No. 2011-212688 (Publication date: Oct. 27, 2011)
[Patent Literature 2]
Japanese Patent Application Publication Tokukaihei No. 7-204819 (Publication date: Aug. 8, 1995)

SUMMARY OF INVENTION

Technical Problem

However, the bearing devices disclosed in Patent Literature 1 support the casting mold in a direction perpendicular to a rotation axis of the casting mold, and it is therefore difficult to surely support the casting mold in a case where the casting mold is rotated at a very high speed for improving evenness in thickness. From this, there has been a possibility that vibration of the casting mold is caused.

The present invention is accomplished in view of the problem, and its object is to provide (i) a casting mold supporting structure which inhibits vibration of a casting mold even during high speed rotation of the casting mold, (ii) a casting machine including the casting mold supporting structure, (iii) a method for producing a cast product with use of the casting machine, and (iv) a casting mold whose vibration during rotation is inhibited.

Solution to Problem

In order to attain the object, a casting mold supporting structure of the present invention includes a support roller for supporting a part of a casting mold that is used in centrifugal casting, the casting mold has a supported surface at which the casting mold is supported by the support roller, the supported surface being inclined with respect to a rotation axis of the casting mold.

Advantageous Effects of Invention

According to an aspect of the present invention, it is possible to inhibit vibration during rotation of the casting mold and to surely support the casting mold even in a case where a support roller has been abraded. This makes it possible to carry out high speed rotation of the casting mold in centrifugal casting.

DESCRIPTION OF EMBODIMENTS

Embodiment 1

The following description will discuss an embodiment of the present invention with reference to FIGS. 1 through 6, FIG. 11, FIG. 15, and FIG. 16.

<Configuration of Casting Machine 100>

A casting machine is known which, as disclosed in Patent Literature 2, includes (as a molten metal supplying structure of the casting machine) a chute that has a groove for receiving molten metal supplied via a pouring gate from a ladle and guiding, in a horizontal direction, the molten metal thus received.

Figure 15:
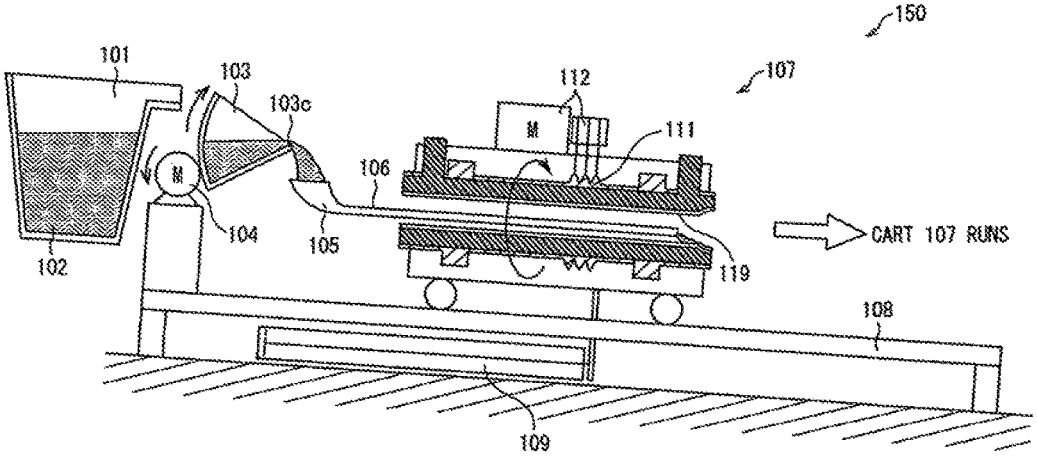
FIG. 15 is a cross-sectional view illustrating an example of a conventional casting machine at a time point at which casting is started.

FIG. 15 is a cross-sectional view illustrating an example of the conventional casting machine.

A casting machine 150 illustrated in FIG. 15 includes a triangular ladle 103 to which molten metal 102 is supplied from a fixed ladle 101, a motor 104, a chute 105, a trough (groove) 106, a cart 107, a cart run section 108, and a cylinder 109. The cart 107 includes a mold 119, a sleeve 111, and a mold rotating mechanism 112.

In the casting machine 150 illustrated in FIG. 15, the molten metal 102 is supplied to the mold 119 in the cart 107 of the casting machine 150 via the chute 105 whose surface is coated with a mold wash (such as graphite) and via the trough 106. According to the arrangement, the molten metal 102 is supplied to the mold 119 as the triangular ladle 103 is tilted, and an amount of the molten metal 102 to be supplied is proportional to a tilted angle of the triangular ladle 103.

The casting machine 150 has the following problem in relation to the chute 105.

That is, according to the triangular ladle 103, the molten metal 102 is supplied always from the vicinity of a pivot 103*c* of a sector form. Moreover, the pivot 103*c* serves as a swinging shaft of the triangular ladle 103, and therefore the pivot 103*c* is fixed even when the triangular ladle 103 is swung. Consequently, the chute 105 is to receive, always at the same position, the molten metal 102 supplied from the triangular ladle 103. This may cause seizing if a thickness of the mold wash applied to the surface of the chute 105 is thin at a position at which the molten metal makes contact with the chute 105. On the other hand, if the mold wash is thickly applied, the mold wash is more likely to be peeled off. If the peeled mold wash is mixed in the molten metal 102, quality of a cast product may be deteriorated.

Under the circumstances, it has been needed to attain a new molten metal supplying structure for solving the problem in relation to the chute 105, based on diligent study by the inventors of the present invention.

The present invention is accomplished in view of the problem, and its object is to provide (i) a molten metal supplying structure that includes a chute and can reduce damage on the chute, (ii) a casting machine including the molten metal supplying structure, and (iii) a method for producing a cast product with use of the casting machine.

Figure 1:
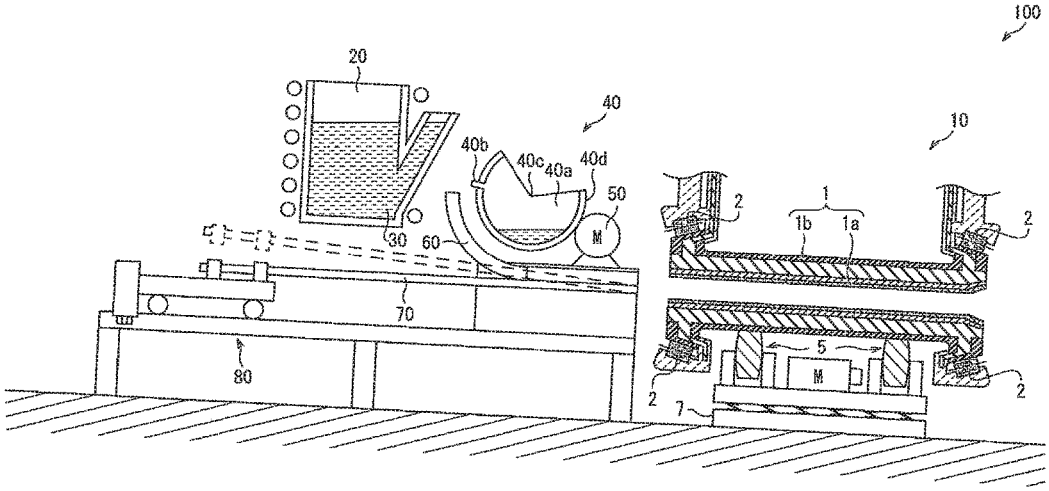
FIG. 1 is a cross-sectional view schematically illustrating a configuration of a casting machine in accordance with Embodiment 1 of the present invention.

FIG. 1 is a cross-sectional view schematically illustrating a configuration of a casting machine 100 in accordance with Embodiment 1 of the present invention. Specifically, FIG. 1 illustrates a state at a time point at which casting is ended.

The casting machine 100 illustrated in FIG. 1 includes a cast product forming section 10, an arc ladle (ladle) 40 to which molten metal 30 is supplied from a fixed ladle 20, a motor 50, a chute 60, a trough 70, and a trough move section 80. The arc ladle 40 includes a ladle body 40*a* and a nozzle (pouring gate) 40*b*.

The ladle body 40*a* retains the molten metal 30. The ladle body 40*a* has a bottom surface portion 40*d* whose shape in a first cross section (i.e., a cross section in parallel with a plane defined by a vertical direction and a direction in which molten metal is supplied from the ladle body to an outside, i.e., a plane of a sheet on which FIG. 1 is illustrated) forms a first arc centered on a center 40*c*. In other words, the first cross section of the ladle body 40*a* is in a sector form whose pivot is the center 40*c*. The ladle body 40*a* is swung around the center 40*c* (serving as a swinging shaft) by the motor 50 on the plane defined by the vertical direction and the direction in which the molten metal 30 is supplied from the ladle body 40*a* to the outside. Note that the bottom surface portion 40*d* is provided so as to extend along the swinging shaft (i.e., in a front-back direction of the sheet on which FIG. 1 is illustrated).

The nozzle 40*b* is provided in the bottom surface portion 40*d*. The arc ladle 40 is configured such that the molten metal 30 retained in the ladle body 40*a* can be supplied to the outside via the nozzle 40*b*. By controlling a swing angle of the ladle body 40*a* by the motor 50, it is possible to adjust an amount of the molten metal 30 to be supplied from the ladle body 40*a* to the outside. Moreover, the nozzle 40*b* is also swung in accordance with the swing of the ladle body 40*a*.

The chute 60 is a groove-like member for receiving the molten metal 30 supplied from the arc ladle 40 and guiding, in a horizontal direction, the molten metal 30 thus received. The chute 60 has a surface which is coated with a mold wash (such as graphite). The molten metal 30 guided by the chute 60 is then supplied to the trough 70.

In the first cross section, an angle θ (see FIG. 11) formed by (i) the direction in which the molten metal 30 is supplied from the ladle body 40*a* to the outside and (ii) a direction in which the molten metal 30 is guided by the chute 60 is 90° or more and 270° or less, preferably 180° or less. Here, the direction in which the molten metal 30 is guided by the chute 60 is a direction in which the molten metal 30 flows at an end of the chute 60 (i.e., a direction in which the molten metal 30 is guided to the trough 70), and the angle θ is an angle by which the direction in which the molten metal 30 is supplied from the ladle body 40*a* to the outside is changed to the direction in which the molten metal 30 is guided by the end of the chute 60 to the trough 70 (i.e., an angle by which a flow direction is changed) (see FIG. 11). In other words, the direction in which the molten metal 30 flows at the end of the chute 60 is, in view of the horizontal direction, substantially opposite to the direction in which the molten metal 30 is supplied via the nozzle 40*b*. As such, the flow direction of the molten metal 30 supplied from the arc ladle 40 is greatly changed by the chute 60. It is therefore possible to buffer a flow speed of the molten metal 30 supplied from the arc ladle 40. This makes it possible to stabilize the flow of the molten metal 30 supplied from the chute 60. Moreover, the chute 60 has, in the first cross section, a cross sectional shape forming a second arc which (i) is centered on the center 40*c* and (ii) is farther from the center 40*c* than the first arc. According to the arrangement, it is easy to set a shortest distance d between the bottom surface portion 40*d* and the chute 60 (see FIG. 11) to be constant. By setting the shortest distance d to be constant, it is possible to further stabilize the guiding of the molten metal 30 by the chute 60.

The trough 70 is a groove through which the molten metal 30 flows. The trough 70 extends while being inclined so as to descend to a cast product forming section 10 side. The trough move section 80 is, for example, a rail on which the cart moves in a direction in which the trough 70 extends. The trough 70 can be configured such that the trough 70, which is inclined so as to be in parallel with the rail in a normal state, is further inclined with respect to the rail so as to descend to the cast product forming section 10 side.

In the casting machine 100, a position of the nozzle 40*b* can be changed by swinging the ladle body 40*a*. This makes it possible to appropriately change, in accordance with a swing angle of the ladle body 40*a*, a position at which the chute 60 receives the molten metal 30. Consequently, it is possible to inhibit seizing caused on a surface of the chute 60 without thickly applying the mold wash to the surface of the chute 60 which surface makes contact with the molten metal 30. This allows reduction in damage on the chute 60.

Figure 11:
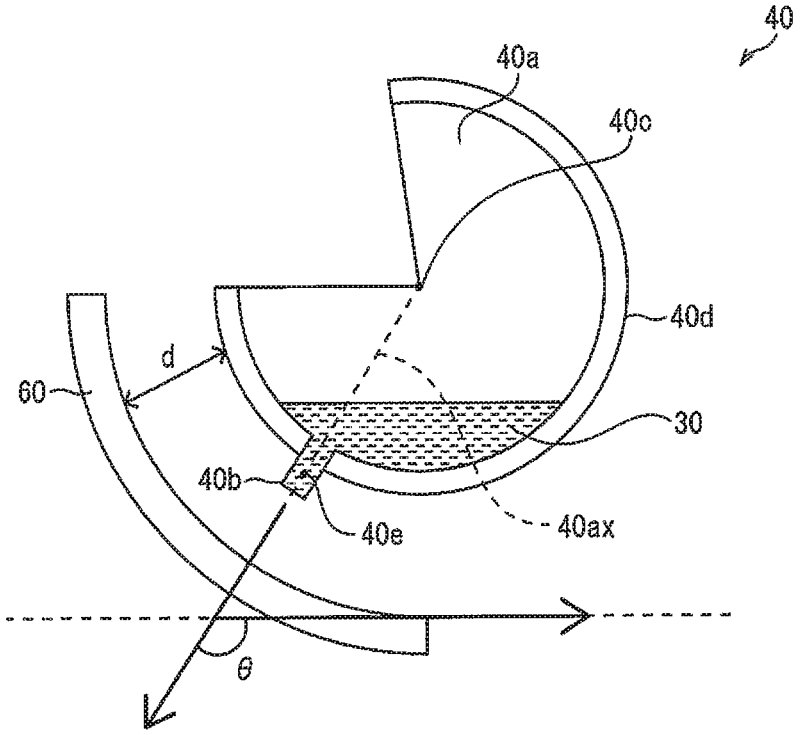
FIG. 11 is an enlarged view of an arc ladle and a chute constituting a molten metal supplying structure provided in the casting machine in accordance with Embodiment 1 of the present invention.
Figure 16:
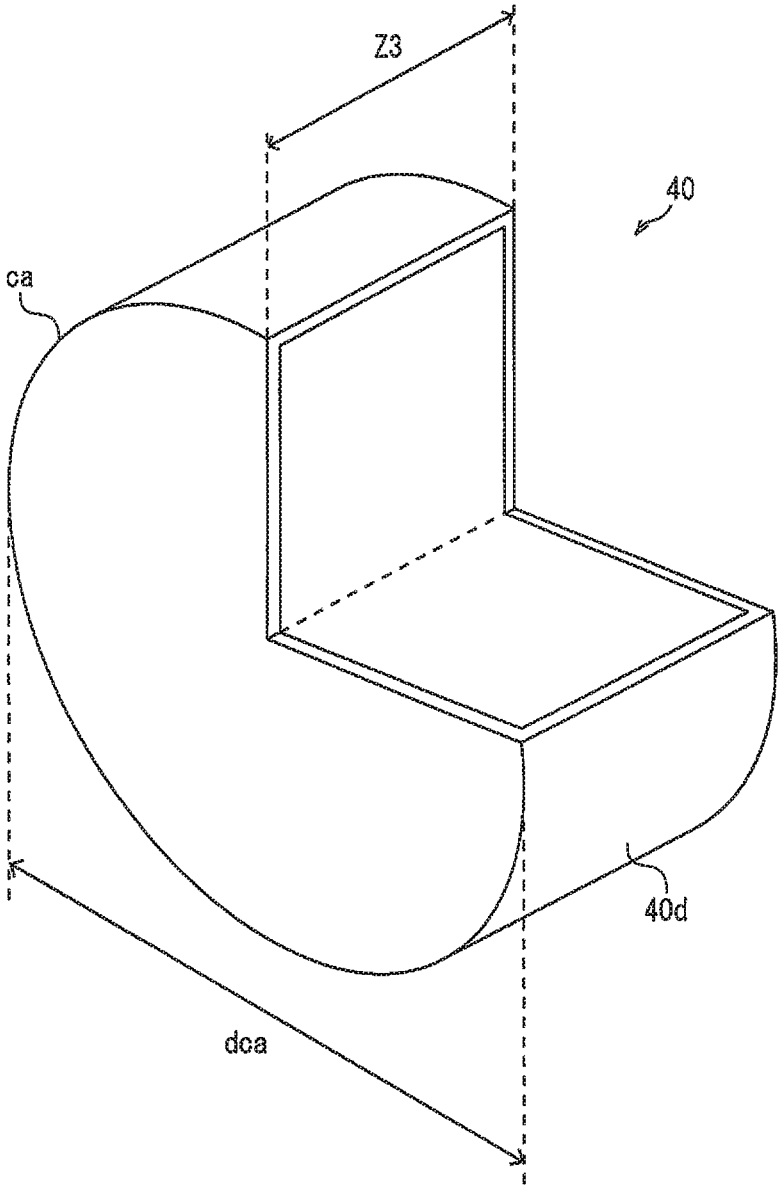
FIG. 16 is a perspective view of the arc ladle illustrated in FIG. 11.

A width Z3 of the bottom surface portion 40*d* in the direction along the swinging shaft is smaller than a diameter dca of a circle ca having the first arc (see FIG. 11 and FIG. 16). FIG. 16 is a perspective view of the arc ladle 40. In other words, the width of the bottom surface portion 40*d* is smaller than a maximum width of a side surface portion which is of the ladle body 40*a* and has a sector form. By thus making smaller the width of the ladle body 40*a* in the direction perpendicular to the direction in which the molten metal is supplied via the nozzle 40*b*, it is possible to reduce a change in amount of supplied molten metal 30 in accordance with swing of the arc ladle 40. This makes it possible to easily control an amount of the molten metal 30 to be supplied.

Moreover, as illustrated in FIG. 11, it is preferable that the nozzle 40*b* has the substantially cylindrical shape and, in the first cross section, a shaft center 40*ax* of the nozzle 40*b* is located on a line connecting the center 40*c* (swinging shaft) and a center 40*e* of the nozzle 40*b*. With the configuration, it is possible to smoothen a flow of the molten metal 30 that passes through the nozzle 40*b*.

As such, according to the present invention, it is possible, in the molten metal supplying structure having the chute, to (i) stabilize a flow of the molten metal, (ii) inhibit deterioration in quality of a cast product, and (iii) reduce damage on the chute.

(Configuration of Cast Product Forming Section 10)

Figure 2:
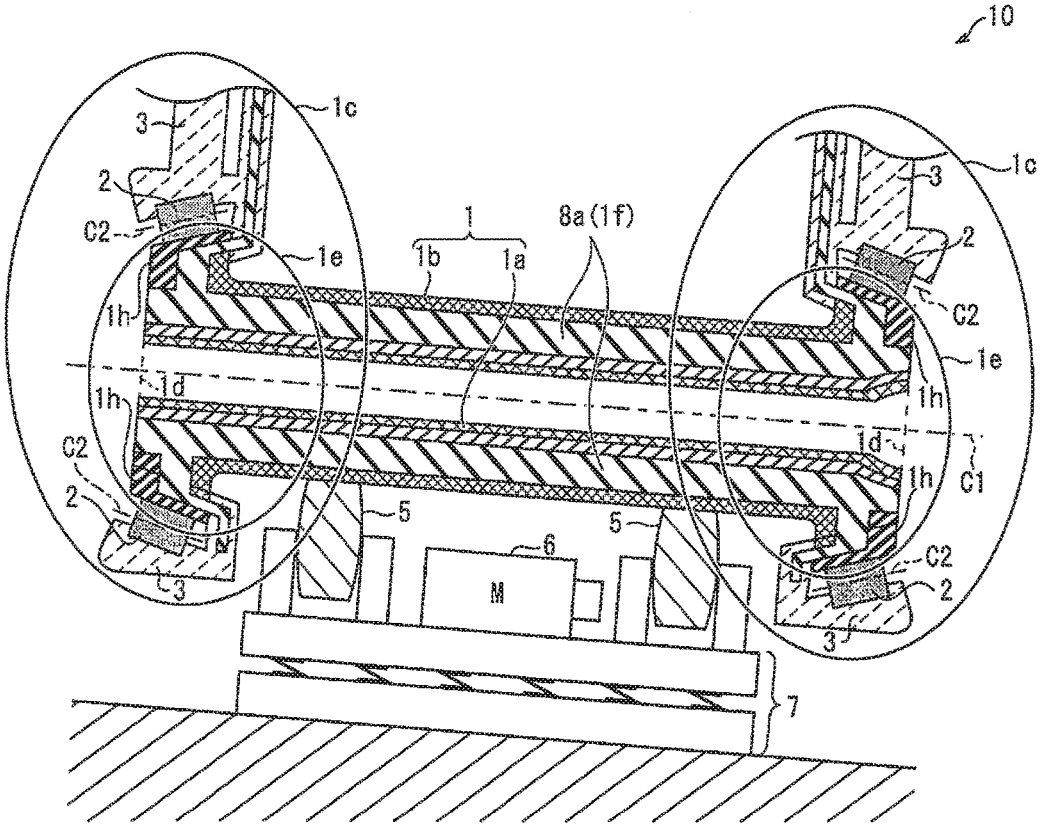
FIG. 2 is a cross-sectional view schematically illustrating a configuration of a cast product forming section included in the casting machine.
Figure 3:
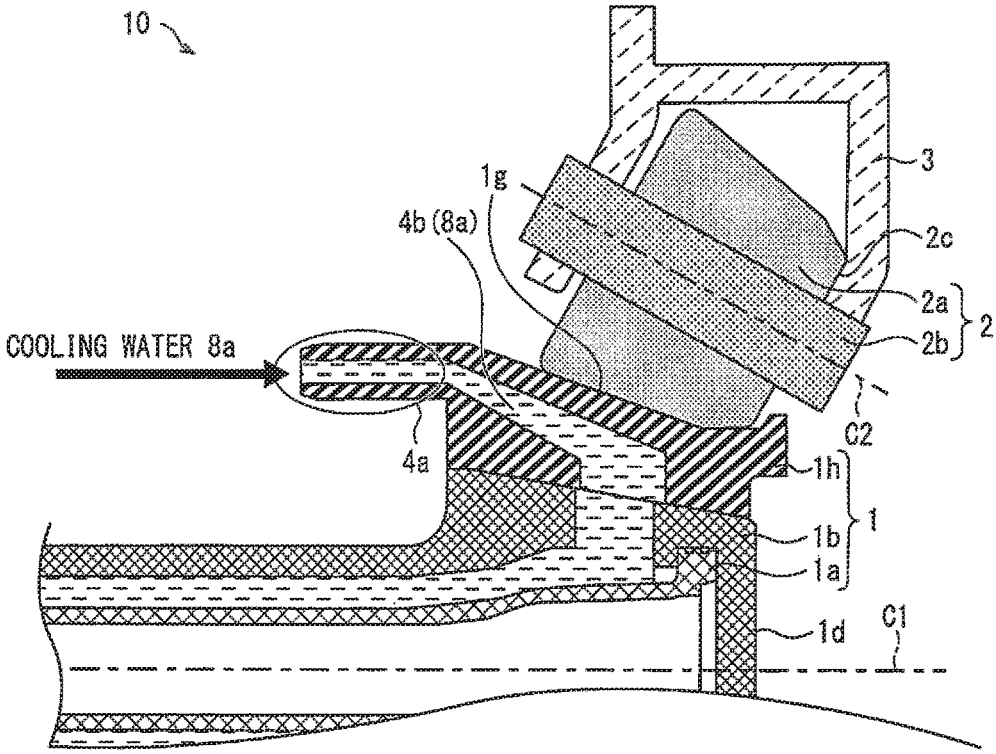
FIG. 3 is a cross-sectional view schematically illustrating a configuration around an end portion of a casting mold provided in the cast product forming section.

FIG. 2 is a cross-sectional view schematically illustrating a configuration of the cast product forming section 10 included in the casting machine 100. FIG. 3 is a cross-sectional view schematically illustrating a configuration around an end portion 1*e* of a casting mold 1 provided in the cast product forming section 10.

As illustrated in FIG. 2, the cast product forming section 10 includes a casting mold 1, a support roller 2, a support roller holder 3, a casting mold rotating roller 5, a motor 6, and a vibration damping base 7.

The casting mold 1 has a mold 1*a*, a sleeve 1*b*, and a water jacket roller 1*h*. Each of the mold 1*a* and the sleeve 1*b* has a cylindrical shape. Each of end portions 1*e* (part) constituted by the sleeve 1*b* and the water jacket roller 1*h* has a circular truncated cone shape whose central axis conforms to a rotation axis C1 of the casting mold 1. Moreover, the mold 1*a*, the sleeve 1*b*, and the water jacket roller 1*h* are concentrically arranged so that the sleeve 1*b* and the water jacket roller 1*h* surround the mold 1*a*.

By thus shaping the end portion 1*e* of the casting mold 1 into the circular truncated cone, force can be applied to the end portion 1*e* in a rotation axis C1 direction and a direction perpendicular to the rotation axis C1 direction. This makes it possible to more firmly support the casting mold 1 by the support roller 2.

Note that an effect similar to that described above can be brought about by a configuration in which a supported surface (i.e., a side surface 1*g* of the end portion 1*e* having the circular truncated cone shape; see FIG. 3) which is of the casting mold 1 and at which the casting mold 1 is supported by the support roller 2 is inclined with respect to the rotation axis of the casting mold 1.

By thus configuring the casting mold 1 by separate members, i.e., the mold 1*a*, the sleeve 1*b*, and the water jacket roller 1*h* as above described, it is possible to easily carry out repair by replacing a member even if a surface of the water jacket roller 1*h* supported by the support roller 2 is abraded. Further, it is possible to obtain a casting mold 1 having a complicated shape.

It is preferable that the side surface 1*g* (i.e., the supported surface supported by the support roller; see FIG. 3) of the end portion 1*e* which is of the casting mold 1 and has the circular truncated cone shape is inclined with respect to the rotation axis C1 at an angle of 10° or more and 50° or less. Note that, in Embodiment 1, the inclined angle is 20°.

By setting the inclined angle as above described, pressing force by the support roller 2 is appropriately applied to the side surface 1*g* in the rotation axis C1 direction and the direction perpendicular to the rotation axis C1 direction. It is therefore possible to more stably support the casting mold 1, and accordingly to carry out high speed rotation of the casting mold 1 more safely.

Further, a space 1*f* is provided between the mold 1*a* and the sleeve 1*b*. It is therefore possible to cool down the mold 1*a* by supplying cooling water 8*a* from an outside to the space 1*f* via the water jacket roller 1*h*.

Note that the molten metal 30 which has been guided to the trough 70 falls from an end portion of the trough 70 (hereinafter, referred to as "end of the trough 70") on the cast product forming section 10 side and is then guided to the mold 1*a*. That is, the end of the trough 70 serves as a part for supplying the molten metal 30 to the mold 1*a*.

The support roller 2 is a member for supporting the end portion 1*e* of the casting mold 1 while rotating the casting mold 1 during casting. As illustrated in FIG. 3, the support roller 2 includes a support roller body 2*a* and a shaft section 2*b* and is configured so that the support roller body 2*a* can freely rotate around the rotation axis C2. The support roller body 2*a* has an outer shape of a substantially circular truncated cone, and the support roller body 2*a* is arranged such that an end surface of the support roller body 2*a* which end surface has a smaller area, in other words, an upper base surface 2*c* of the circular truncated cone in which the support roller body 2*a* is shaped faces an outer side of the casting mold 1.

By thus arranging the support roller 2, a supporting surface of the support roller 2 and the rotation axis C2 are inclined with respect to the rotation axis C1 of the casting mold 1 so that force for pressing the end portion 1*e* of the casting mold 1 by the support roller 2 is directed to a center part of the casting mold 1 in the rotation axis C1 direction. This makes it possible to support the casting mold 1 merely by causing the support roller 2 to make contact with the side surface 1*g* of the end portion 1*e* which is of the casting mold 1 and has the circular truncated cone shape. It is therefore unnecessary to consider a mechanism for moving the support roller 2 in the direction perpendicular to the rotation axis C1, and it is possible to simplify a mechanism of the casting machine 100.

Moreover, even in a case where a surface of the support roller 2 which surface makes contact with the end portion 1*e* of the casting mold 1 has been abraded by rotation of the casting mold 1, the support roller 2 can support the end portion 1*e* of the casting mold 1 in a state similar to that before the abrasion simply by moving the support roller 2 in parallel with the rotation axis C1 toward the center part of the casting mold 1 in the rotation axis C1 direction. Therefore, even in a case where high speed rotation of the casting mold 1 has been continued for a predetermined time period, it is possible to maintain stable support of the casting mold 1 by the support roller 2.

Further, a rolling bearing (not illustrated) is provided in a gap between a hollow part (not illustrated) of the support roller body 2*a* and the shaft section 2*b* so that the support roller body 2*a* can support the casting mold 1 while rotating. The rolling bearing can be a commercially available one having a small inner diameter of bearing. With the configuration, it is possible to control an actual dn value of the rolling bearing in the support roller 2 to be a limit dn value or less, even if a rotation speed of the casting mold 1 is increased. This allows high speed rotation of the casting mold 1.

Here, the "dn value" is a value obtained by multiplying the inner diameter of the rolling bearing by a rotation speed per minute of the shaft section. The "limit dn value" is a value serving as a criterion for obtaining a limit rotation speed per minute of a particular rolling bearing. The limit dn value is determined in advance depending on factors such as a type and dimensions of a bearing, a type and a material of a cage, a bearing load, a lubricating method, and a cooling status of the bearing and in the vicinity of the bearing.

The support roller holder 3 is a member for holding the support roller 2 at a predetermined position so that the casting mold 1 is supported by the support roller 2. When the casting mold 1 is mounted or removed, the support roller holder 3 is integrally moved with the support roller 2 in the rotation axis C1 direction. Specifically, when the casting mold 1 is mounted, the support roller holder 3 is moved toward the center part of the casting mold 1 in the rotation axis C1 direction, and when the casting mold 1 is removed, the support roller holder 3 is moved toward the outer side of the casting mold 1.

As such, it is possible to release the support of the casting mold 1 merely by moving the support roller 2 and the support roller holder 3 in the rotation axis C1 direction, and it is therefore possible to easily replace the casting mold 1.

The water jacket roller 1*h* is a member which has a substantially circular truncated cone shape and is arranged so as to be concentric with the sleeve 1*b* and to surround an end portion which is of the sleeve 1*b* and has the circular truncated cone shape. During casting, the water jacket roller 1*h* is integrally rotated with the mold 1*a* and the sleeve 1*b*. Moreover, as illustrated in FIG. 3, a connection part 4*a* which is provided in the water jacket roller 1*h* and has a substantially hollow cylindrical shape is configured to be partially and constantly located in an external water inlet/outlet port (not illustrated) during rotation.

A space 4*b* is provided inside the water jacket roller 1*h* and the connection part 4*a* so as to penetrate (i) a contact surface between the water jacket roller 1*h* and the sleeve 1*b* and (ii) an end portion of the connection part 4*a*. Here, the space 4*b* serves as a path through which the cooling water 8*a* flows, and the cooling water 8*a* which has been externally supplied flows to the space 1*f* via the space 4*b* and cools down the mold 1*a* and the sleeve 1*b*. Subsequently, the cooling water 8*a* which has been used to cool down the mold 1*a* and the sleeve 1*b* is discharged through another path.

The casting mold rotating rollers 5 are provided on the vibration damping base 7 along the rotation axis C1 so as to (i) be arranged symmetrically with respect to the center part of the casting mold 1 in the rotation axis C1 direction and (ii) make contact with a lower part of the casting mold 1 in the vicinity of the respective end portions 1*e*. Further, the casting mold rotating rollers 5 are rotated by the motor 6 that is also provided on the vibration damping base 7, and thus the casting mold 1 is rotated around the rotation axis C1.

Note that the method for rotating the casting mold 1 is not limited to the above described casting mold rotating roller. For example, it is possible to employ a configuration (not illustrated) in which one belt is provided at the center part of the casting mold 1 in the rotation axis C1 direction and the casting mold 1 is rotated by a motor via the belt. Alternatively, two belts can be provided on the respective end portions 1*e* of the casting mold 1.

The vibration damping base 7 is provided for inhibiting vibration of the casting mold 1 during rotation of the casting mold 1. Moreover, as above described, the vibration damping base 7 is provided with the casting mold rotating rollers 5 and the motor 6, and the casting mold 1 is rotated by driving of the casting mold rotating rollers 5 with the motor 6.

(Configuration of Casting Mold Supporting Structure 1*c*)

As illustrated in FIG. 2, the casting machine 100 includes a casting mold supporting structure 1*c*. The casting mold supporting structure 1*c* includes the end portion 1*e* (a part which is of the casting mold and is formed in a circular truncated cone shape) of the casting mold 1, the support roller 2, and the support roller holder 3.

Figure 4:
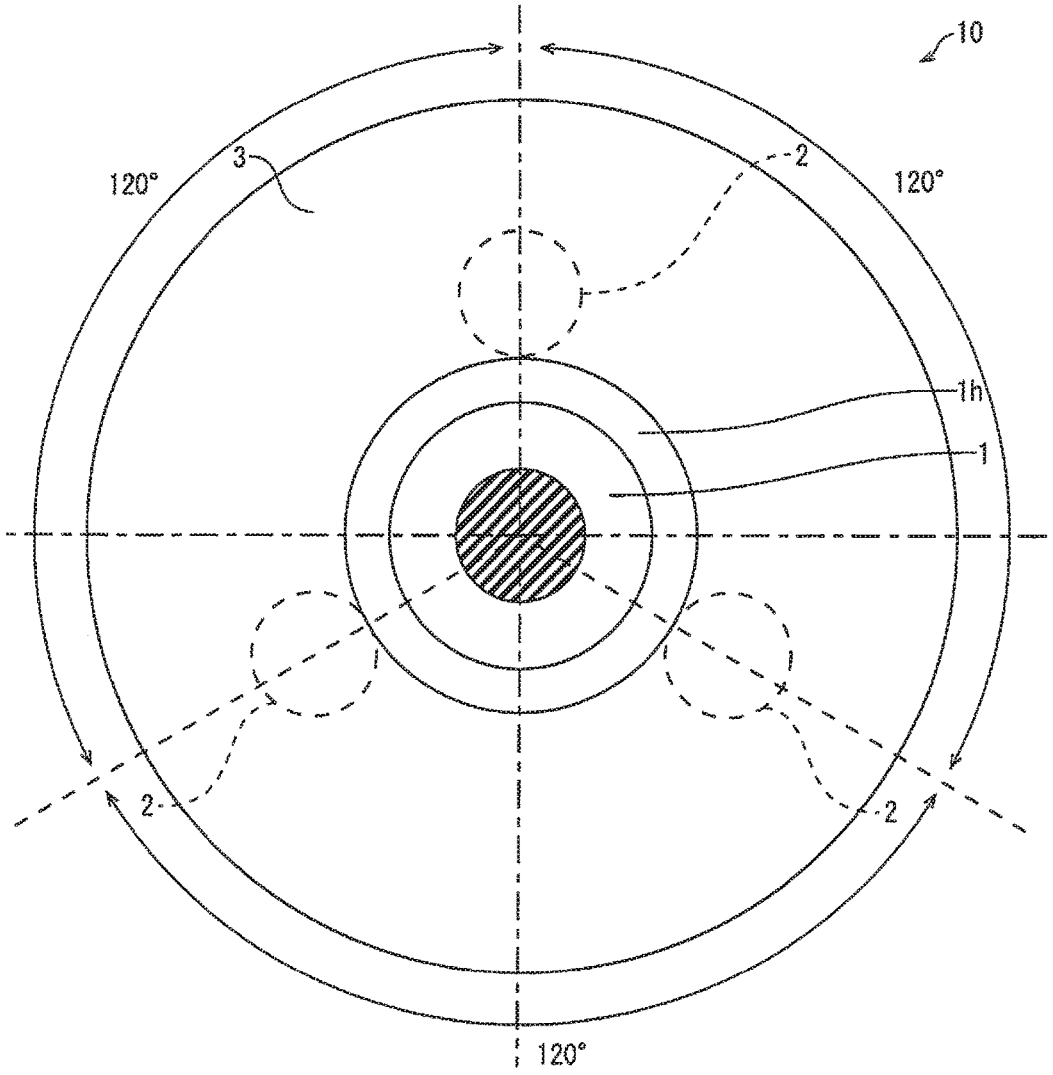
FIG. 4 is a front view schematically illustrating a configuration of the cast product forming section.

As illustrated in FIG. 4, the casting mold 1 is supported by three support rollers 2 at the end portion 1*e* of the casting mold 1 when an end surface 1*d* of the casting mold 1 is viewed along the rotation axis C1. The three support rollers 2 are arranged so that each of angles becomes 120 degrees which angle is formed by (i) a line connecting the rotation axis C1 with one of adjacent two of the three support rollers 2 and (ii) a line connecting the rotation axis C1 with the other of the adjacent two of the three support rollers 2. In other words, when the end surface 1*d* of the casting mold 1 is viewed along the rotation axis C1, the three support rollers 2 are arranged so that angles become uniform each of which is formed by (i) a line connecting the rotation axis C1 with one of adjacent two of the three support rollers 2 and (ii) a line connecting the rotation axis C1 with the other of the adjacent two of the three support rollers 2.

By thus arranging the three support rollers 2, force is uniformly applied to the end portion 1*e* of the casting mold 1, and therefore the casting mold 1 can be more stably supported. This makes it possible to more safely carry out high speed rotation of the casting mold 1.

Note that the number and the arrangement of support rollers 2 for supporting the end surface 1*d* of the casting mold 1 are not limited to those described above. For example, it is possible to employ a configuration (not illustrated) in which one end surface 1*d* is supported by six support rollers 2 which are arranged so that each of angles becomes 60 degrees which angle is formed by (i) a line connecting the rotation axis C1 with one of adjacent two of the six support rollers 2 and (ii) a line connecting the rotation axis C1 with the other of the adjacent two of the six support rollers 2. Alternatively, three support rollers 2 can be arranged so that the angles formed by the adjacent two of the three support rollers 2 and the rotation axis C1 are different from each other, provided that the casting mold 1 is stably supported by the three support rollers 2. In other words, the mold supporting structure 1*c* may be configured so that the end surface 1*d* of the casting mold 1 is supported by the plurality of support rollers 2 which are provided on an upper side and a lower side of the rotation axis C1 of the casting mold 1 in a vertical direction. By thus supporting the end surface 1*d* of the casting mold 1, (i) the end surface 1*d* is to be pressed by the plurality of support rollers 2 at a plurality of positions and (ii) the pressing force is to be applied, from the upper side to the lower side in the vertical direction, at at least one of the plurality of positions. It is therefore possible to efficiently inhibit vibration in of the casting mold 1 in the vertical (i.e., up-and-down) direction while the casting mold 1 is rotated.

Figure 5:
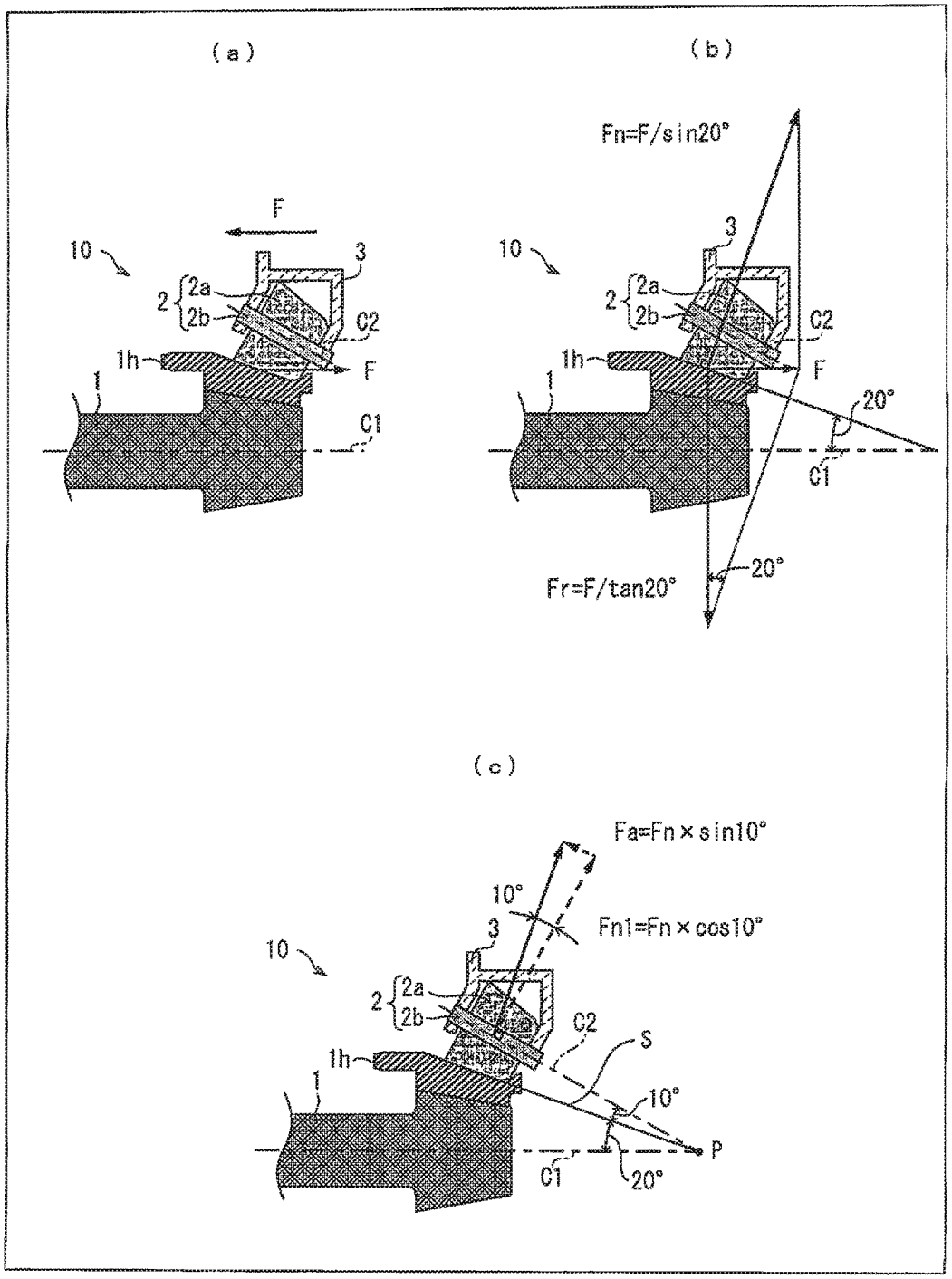
In FIG. 5, (a) is a schematic view illustrating a state in which reaction force is applied to a support roller in a case where the casting mold is supported by the support roller provided in the cast product forming section; (b) is a schematic view illustrating resolved components of the reaction force which are substantially applied to the support roller; and (c) is a schematic view illustrating a state in which one of the resolved components is further resolved into a component that is in parallel with a rotation axis of the support roller and a component that is perpendicular to the rotation axis.

Moreover, as illustrated in (a) of FIG. 5, in a case where the end portion 1*e* of the casting mold 1 is supported by pressing force F that is applied along the rotation axis C1 by the support roller 2 toward the center part of the casting mold 1 in the rotation axis C1 direction, reaction force F is applied to the support roller 2 in a direction opposite to that of the pressing force F.

Here, the water jacket roller 1*h* has the outer shape of the circular truncated cone at the end portion 1*e* of the casting mold 1, and therefore, as illustrated in (b) of FIG. 5, the reaction force F is resolved into (i) a force component Fr that is applied in the direction perpendicular to the rotation axis C1 direction and (ii) a force component Fn that is applied in a direction perpendicular to the contact surface between the water jacket roller 1*h* and the support roller 2. Consequently, the force component Fn is applied to the support roller 2. In Embodiment 1, an extended line S that is extended from the contact surface of the water jacket roller 1*h* and is on a plane including the rotation axis C1 is inclined at 20° with respect to the rotation axis C1 of the casting mold 1. Therefore, the followings are satisfied: $Fr=F/\sin 20°$, $Fn=F/\tan 20°$.

Further, as illustrated in (c) of FIG. 5, the force component Fn applied to the support roller 2 is further resolved into (i) a force component Fa that is applied in parallel with the rotation axis C2 of the support roller 2 and (ii) a force component Fn1 that is applied in a direction perpendicular to the rotation axis C2, because the support roller body 2*a* has the outer shape of the circular truncated cone. As such, the force component Fn applied to the support roller 2 can be dispersed in two directions. In Embodiment 1, the rotation axis C2 is inclined at 10° with respect to the extended line S. Therefore, the followings are satisfied: $Fa=Fn\times\sin 10°$, $Fn1=Fn\times\cos 10°$.

As such, because the support roller body 2*a* has the outer shape of the circular truncated cone, it is possible to cause the reaction force Fn applied to the support roller 2 to be dispersed in different directions, and it is therefore possible to further inhibit breakage of the support roller 2 as compared with, for example, a case where the outer shape of the support roller body 2*a* is a columnar shape.

Note that the outer shape of the support roller body 2*a* is not limited to the circular truncated cone shape and can be, for example, the columnar shape.

Figure 6:
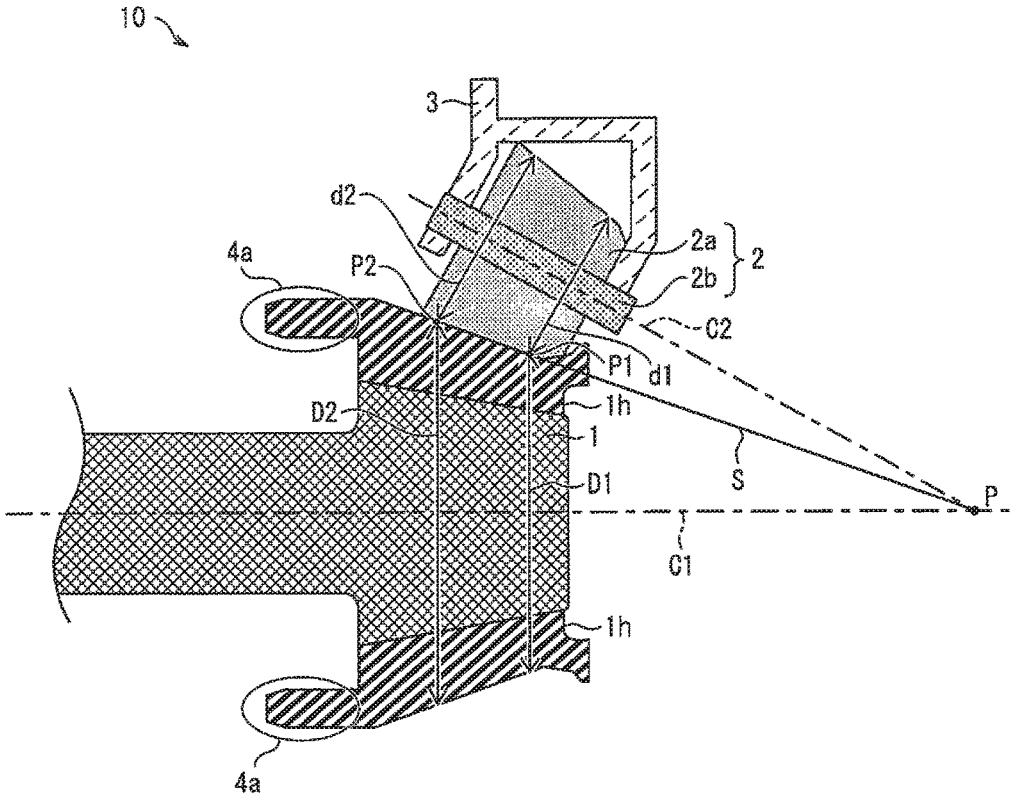
FIG. 6 is a schematic view illustrating a relation between (i) an angle at which an inclined surface of a water jacket roller included in the cast product forming section is inclined with respect to the rotation axis (casting mold) and (ii) an angle at which a shaft section in the support roller is inclined with respect to the rotation axis.

Moreover, as above described, the support roller 2 is arranged such that the end surface of the support roller body 2*a* which end surface has the smaller area faces the outer side of the casting mold 1. Therefore, as illustrated in FIG. 6, the rotation axis C1 of the casting mold 1, the rotation axis C2 of the support roller 2, and the extended line S that is extended to the outer side from the side surface 1*g* of the end portion 1*e* having the circular truncated cone shape intersect with each other at a particular point P on the rotation axis C1.

Here, assuming that contact points P1 and P2 are arbitrary points on the contact surface between the support roller 2 and the water jacket roller 1*h*, it is preferable to design the inclined surfaces of the support roller 2 and the water jacket roller 1*h* so that a ratio between an outer diameter D1 of the water jacket roller 1*h* and an outer diameter d1 of the support roller 2 at the contact point P1 conforms to a ratio between an outer diameter D2 of the water jacket roller 1*h* and an outer diameter d2 of the support roller 2 at the contact point P2.

By designing the inclined surfaces as above described, it is possible to prevent a difference in rotation caused between portions constituting the support roller 2. This makes it possible to inhibit, during centrifugal casting, slippage of the support roller 2 in the rotation axis C1 direction and slippage of the support roller 2 in the direction perpendicular to the rotation axis C1.

Method for Producing Cast Product

Figure 7:
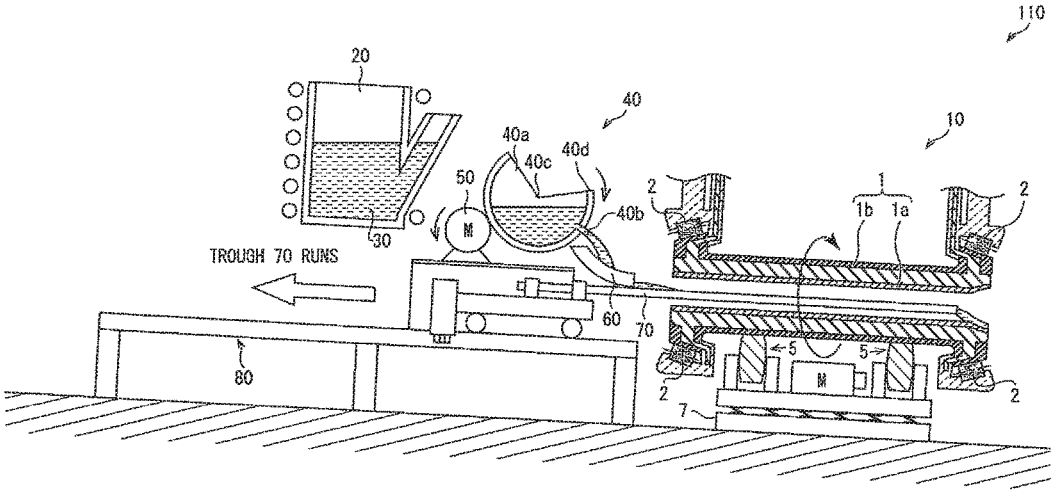
FIG. 7 is a cross-sectional view illustrating a configuration of the casting machine in a modification example at a time point at which casting is started.
Figure 8:
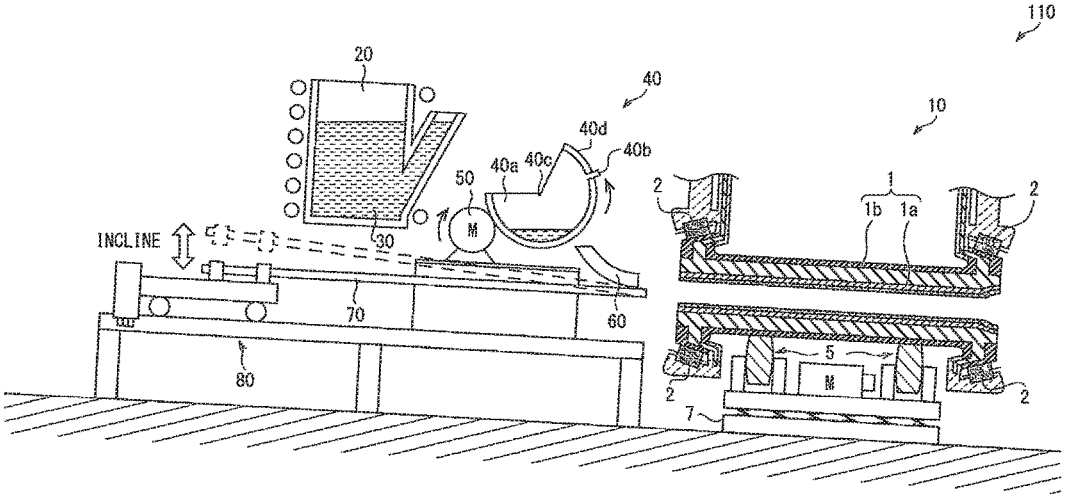
FIG. 8 is a cross-sectional view illustrating a configuration of the casting machine in a modification example at a time point at which casting is ended.

The following description will discuss a method for producing a cast product with use of a casting machine 110, with reference to FIGS. 7 and 8. Each of FIGS. 7 and 8 is a cross-sectional view illustrating a configuration of a casting machine 110 which is a modification example of the casting machine 100 in accordance with Embodiment 1 of the present invention. Specifically, FIG. 7 illustrates a state at a time point at which casting is started, and FIG. 8 illustrates a state at a time point at which casting is ended.

The casting machine 110 illustrated in FIGS. 7 and 8 is different from the casting machine 100 illustrated in FIG. 1 in position of the chute 60.

That is, in the casting machine 110, the chute 60 is provided such that, in the first cross section, an angle θ formed by (i) a direction in which the molten metal 30 is supplied from the ladle body 40*a* to the outside and (ii) a direction in which the molten metal 30 is guided from the end of the chute 60 to the trough 70 becomes smaller than 90°. In other words, a direction in which the molten metal 30 flows at the end of the chute 60 is, in the horizontal direction, substantially identical with a direction in which the molten metal 30 is supplied from the nozzle 40*b*. Moreover, in the casting machine 110, the chute 60 has, in the first cross section, a cross sectional shape which forms an arc that is not centered on the center 40*c* (i.e., the arc is not the second arc).

As compared with the casting machine 110, the casting machine 100 can further stabilize the flow of the molten metal 30 and further stabilize the guiding of the molten metal 30 by the chute 60. However, also in the casting machine 110, it is possible to appropriately change, in accordance with a swing angle of the ladle body 40*a*, a position at which the chute 60 receives the molten metal 30. It is therefore possible to stabilize the flow of the molten metal 30, inhibit deterioration in quality of a cast product, and reduce damage on the chute 60.

Note that the casting machine 110 has a configuration substantially identical with that of the casting machine 100, except that the position of the chute 60 is different from that in the casting machine 100 illustrated in FIG. 1. Therefore, also with the casting machine 100, it is possible to produce a cast product by a production method described below.

When casting with use of the casting machine 110 has been started, first, the molten metal 30 is supplied from the arc ladle 40. The molten metal 30 which has been supplied from the arc ladle 40 is guided to the chute 60 and the trough 70 in this order, and is then supplied to the casting mold 1 (mold 1*a*) from the end of the trough 70 (molten metal supplying step).

In this case, the casting mold 1 is rotated around the rotation axis C1 at a high speed by the casting mold rotating rollers 5 that are driven by the motor 6 (casting mold rotating step).

Further, in this case, the trough 70 is moved by the trough move section 80 so that the end of the trough 70 comes near to the chute 60, as illustrated in FIG. 7. As such, the end of the trough 70 is moved in the mold 1*a* toward the chute 60. Therefore, in a case where a primary position of the trough 70 is set so that the molten metal 30 can be supplied to an end portion of the mold 1*a* which end portion is opposite to the chute 60, the molten metal 30 is to be sequentially supplied in the mold 1*a* from the end portion opposite to the chute 60 to an end portion near to the chute 60.

Further, in this case, the trough 70 can be further inclined with respect to the rail of the trough move section 80 so that the cast product forming section 10 side of the trough 70 descends. This makes it possible to guide all the molten metal 30 which is on the trough 70 from the end of the trough 70 to the mold 1*a* without breaking the flow of the molten metal 30. Consequently, it is possible to enhance efficiency of utilization of the molten metal 30 and to inhibit redundant scrap iron remaining on the trough 70.

At a time point at which the casting by the casting machine 110 is ended, as illustrated in FIG. 8, the end of the trough 70 is located nearer to the chute 60 than to the mold 1*a*. Moreover, the molten metal 30 is supplied across the entire mold 1*a*. Note that the molten metal 30 is preferably supplied, for each cast product, from the arc ladle 40 by an amount that is required for one cast product.

Embodiment 2

Figure 9:
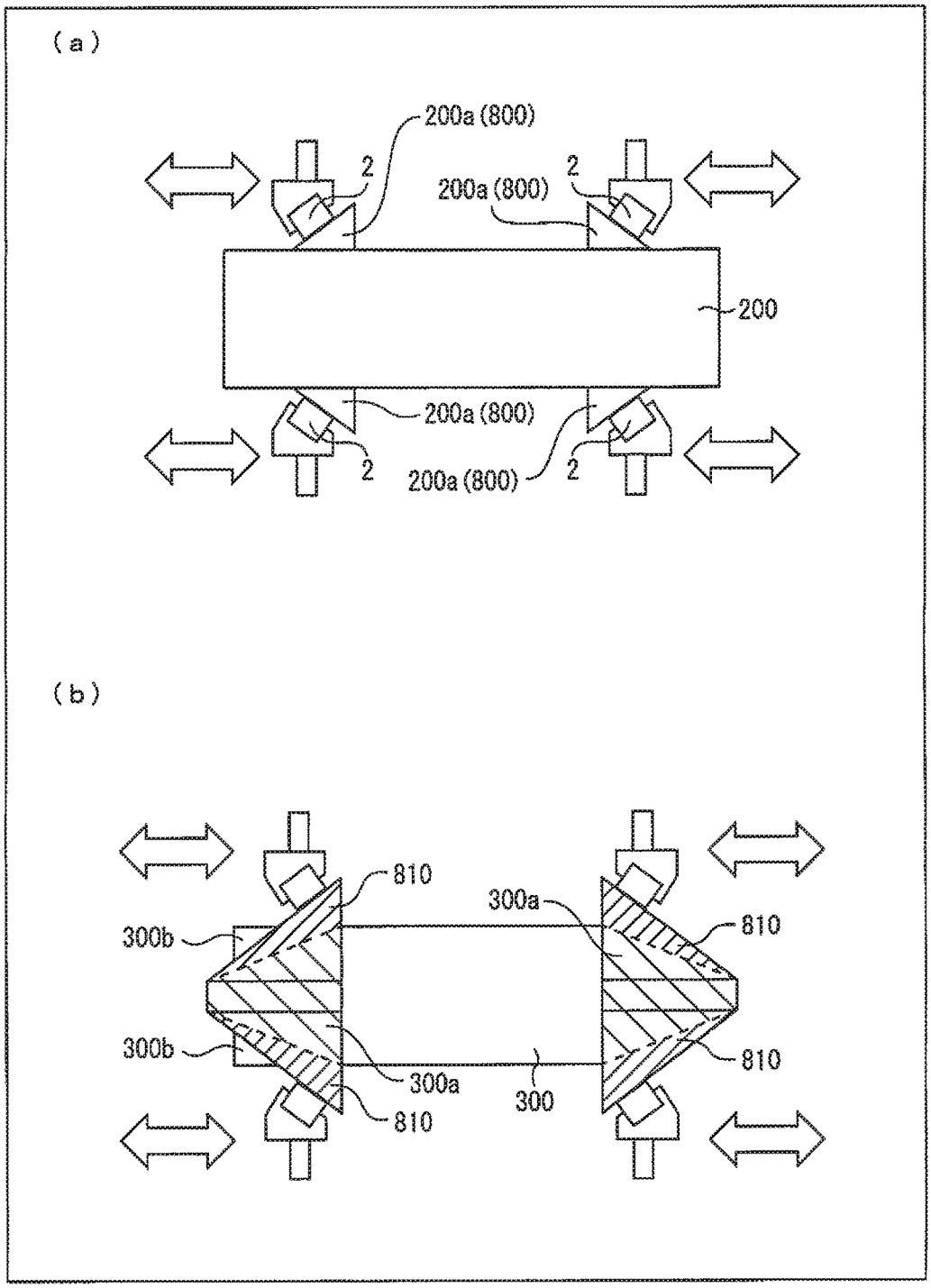
FIG. 9 is a schematic view illustrating, in (a) and (b), a modification example of shapes of both ends of the casting mold and an outer shape of a water jacket roller in the casting machine of the present invention.
Figure 10:
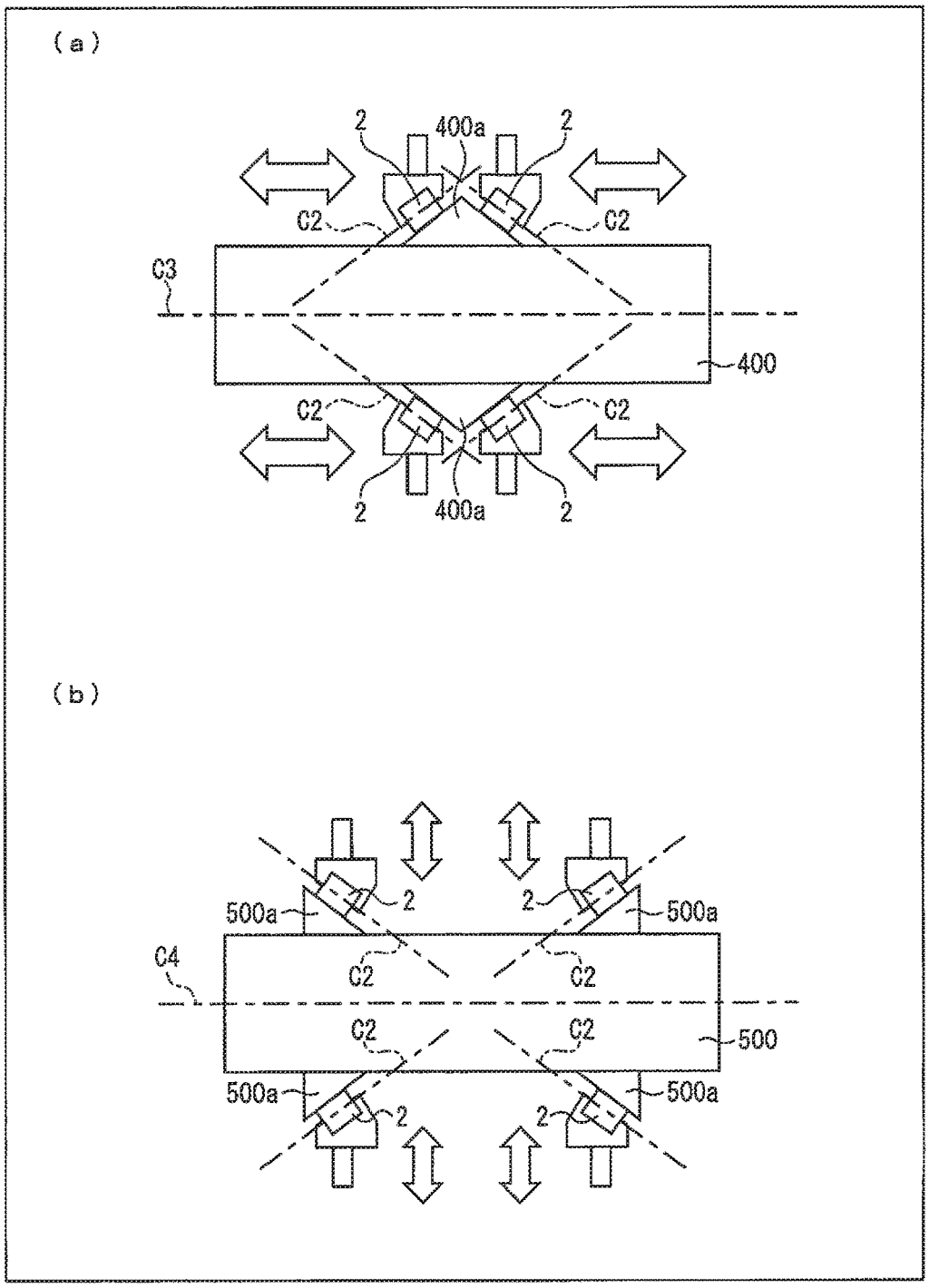
FIG. 10 is a schematic view illustrating, in (a) and (b), a modification example of a method for supporting a casting mold by a support roller in accordance with the present invention.

The following description will discuss another embodiment of the present invention with reference to FIGS. 9 through 11. For convenience of explanation, identical reference numerals are given to constituent members having functions identical with those of the constituent members described in Embodiment 1, and descriptions of such constituent members are omitted here.

<Shape of Both End Portions of Casting Mold>

Each of end portions of a casting mold can have a shape different from that described in Embodiment 1.

For example, as illustrated in (a) of FIG. 9, a casting mold 200 can be employed (i) whose end part has a cylindrical shape and (ii) which is provided with support sections 200*a* (a part which is of the casting mold and is formed in a circular truncated cone shape) (i.e., a side surface in a longitudinal direction is provided) each of which is located between a center part and the end part of the casting mold 200 in a rotation axis direction and is formed in a circular truncated cone shape having an inclined surface inclined at an angle similar to that of the end portion 1*e* of the casting mold 1 in Embodiment 1. In this case, an outer shape of a water jacket roller 800 is substantially identical with that of each of the support sections 200*a*. Note that it is possible to employ a configuration (not illustrated) in which the outer shape of the casting mold 200 itself is the cylindrical shape and only the outer shape of the water jacket roller 800 is substantially identical with that of each of the support sections 200*a*.

Alternatively, as illustrated in (b) of FIG. 9, it is possible to employ a casting mold 300 having an end portion 300*a* whose outer shape is substantially a circular cone shape (with a plane at its tip). Alternatively, a protrusion 300*b* can be provided on an inclined surface of the end portion 300*a*.

<Supporting Method by Support Roller 2>

The support roller 2 can support the casting mold by a method other than the method described in Embodiment 1.

For example, as illustrated in (a) of FIG. 10, a casting mold 400 can be employed which is provided with support sections 400*a* (a part which is of the casting mold and is formed in a circular truncated cone shape) (i.e., a side surface in a longitudinal direction is provided) each of which (i) is located in the vicinity of a center part of the casting mold 400 in a rotation axis C3 direction and (ii) is formed in a circular truncated cone shape having two inclined surfaces each having an inclined angle similar to that of the end portion 1*e* of the casting mold 1 in Embodiment 1. Further, the inclined surfaces of each of the support sections 400*a* are supported by the support rollers 2. Note that the support sections 400*a* do not necessarily need to be located in the vicinity of the center part of the casting mold 400 in the rotation axis C3 direction and can be provided at any position, provided that the casting mold 400 can be stably supported even in a case where the casting mold 400 is rotated at a high speed.

Alternatively, as illustrated in (b) of FIG. 10, a casting mold 500 can be employed which is provided with support sections 500*a* (a part which is of the casting mold and is formed in a circular truncated cone shape) (i.e., side surfaces in a longitudinal direction are provided) in the vicinity of respective ends of the casting mold 500 so that inclined surfaces of the support sections 500*a* are supported by the support rollers 2. In this case, the rotation axis C2 of each of the support rollers 2 is inclined with respect to a rotation axis C4 of the casting mold 500 so that force for pressing each of the support sections 500*a* by the support roller 2 is directed toward an outer side of the casting mold 500.

Even in a case where the above described supporting methods are employed, the rotation axis C2 of the support roller 2 is inclined with respect to the rotation axis (C3, C4) of each of the casting molds 400 and 500, and therefore each of the casting molds 400 and 500 is supported by the support rollers 2 in the rotation axis (C3, C4) direction and in a direction perpendicular to the rotation axis. This makes it possible to more firmly support each of the casting molds 400 and 500, and it is therefore possible to inhibit vibration during rotation of each of the casting molds 400 and 500.

Even in a case where a contact surface between the support roller 2 and each of the casting molds 400 and 500 has been abraded, the support roller 2 can partially support the each of the casting molds 400 and 500 in a state similar to that before the abrasion simply by moving the support roller 2 in parallel with the rotation axis (C3, C4). Therefore, even in a case where high speed rotation of each of the casting molds 400 and 500 has been continued for a predetermined time period, it is possible to maintain stable support of each of the casting molds 400 and 500 by the support roller 2.

In Embodiment 1, the casting mold 1 includes the mold 1*a*, the sleeve 1*b*, and the water jacket roller 1*h*. Note, however, that the casting mold 1 can include only the mold 1*a* without the water jacket roller 1*h* and the sleeve 1*b*. In such a case, the support roller 2 which is inclined directly supports the mold 1*a*.

[Solution to Problem in Relation to Ladle]

The casting machine 150 illustrated in FIG. 15 has the following problem in relation to the triangular ladle 103.

That is, dirt can be mixed in the molten metal 102 retained in the triangular ladle 103. Examples of the dirt encompass oxide or sulfide of the molten metal 102. If the dirt flows out of the triangular ladle 103 together with the molten metal 102 and is supplied to the mold 119, the dirt is mixed in a cast product and consequently quality of the cast product may be deteriorated. Moreover, if the dirt is attached to an inner wall of the triangular ladle 103, the dirt interferes with a flow of the molten metal 102, and therefore an amount of the molten metal 102 to be supplied may become unstable.

Figure 12:
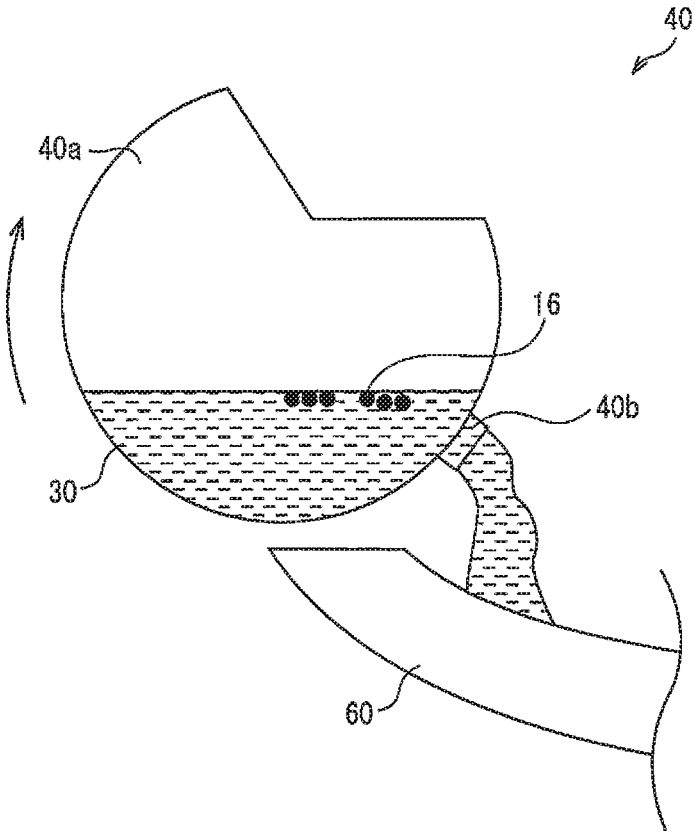
FIG. 12 is a cross-sectional view of the arc ladle and the chute in the casting machine illustrated in FIGS. 7 and 8.

Here, the problem in relation to the triangular ladle 103 can be solved by using the arc ladle 40. The following description will discuss this with reference to FIG. 12. FIG. 12 is a cross-sectional view illustrating the arc ladle 40 and the chute 60 of the casting machine 110.

In the molten metal 30 retained in the ladle body 40*a*, dirt 16 may be mixed. The dirt 16 is so light as to come to a surface of the molten metal 30. Therefore, by supplying the molten metal 30 while keeping the nozzle 40*b* to be sufficiently lower in position than a liquid level of the molten metal 30, it is possible to prevent the dirt 16 from flowing out together with the molten metal 30.

Moreover, by swinging the ladle body 40*a* so that a height of the liquid level of the molten metal 30 becomes constant with respect to the nozzle 40*b* while the molten metal 30 is supplied, it is possible to constantly maintain pressure to be applied to the nozzle 40*b* and accordingly to maintain a constant flow speed of the molten metal 30 that is supplied through the nozzle 40*b*. This makes it possible to easily quantify a supplied amount of the molten metal 30 strictly to some extent.

Figure 13:
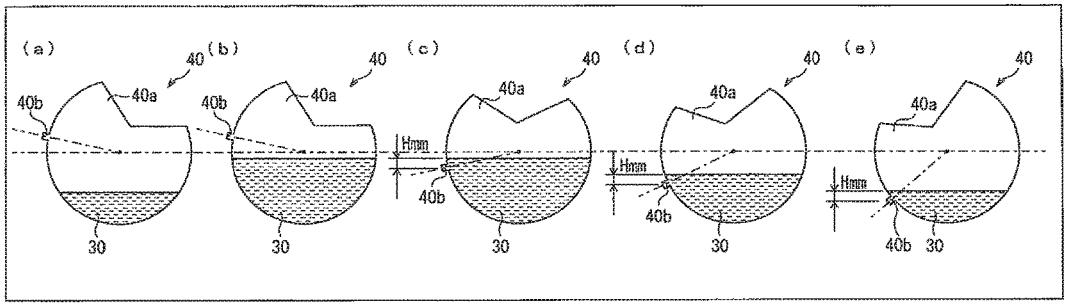
FIG. 13 is a view illustrating, in (a) through (e), a relation in height between a pouring gate of an arc ladle in accordance with the present invention and a liquid level of the molten metal in a time series.

The following description will discuss a mechanism for maintaining a constant flow speed of the molten metal 30 that is supplied through the nozzle 40*b*, with reference to FIG. 13. FIG. 13 is a view illustrating, in a time series, a relation in height between the nozzle 40*b* and the liquid level of the molten metal 30 in the arc ladle 40.

(a) of FIG. 13 illustrates a state before the molten metal 30 is supplied from the fixed ladle 20. In this case, the nozzle 40*b* is located higher than the liquid level of the molten metal 30. Therefore, the molten metal 30 is not supplied from the ladle body 40*a*.

(b) of FIG. 13 illustrates a state immediately after the molten metal 30 has been supplied from the fixed ladle 20. In this case, the nozzle 40*b* is still located higher than the liquid level of the molten metal 30. Therefore, the molten metal 30 is not supplied from the ladle body 40*a*.

(c) of FIG. 13 illustrates a state in which the molten metal 30 is being supplied (early stage). (d) of FIG. 13 illustrates a state in which the molten metal 30 is being supplied (intermediate stage). (e) of FIG. 13 illustrates a state in which the molten metal 30 is being supplied (later stage). While the molten metal 30 is supplied, the ladle body 40*a* is swung so that the nozzle 40*b* is located under the liquid level of the molten metal 30 by a constant height Hmm. Here, the constant height Hmm is set to, for example, 50 mm. With the configuration, the molten metal 30 is supplied from the ladle body 40*a*. Moreover, while the molten metal 30 is supplied (i.e., from the early stage to the later stage), the swing angle of the ladle body 40*a* is controlled so that the nozzle 40*b* is maintained below the liquid level of the molten metal 30 by the constant height Hmm. It is therefore possible to keep, while the molten metal 30 is supplied, a constant flow speed of the molten metal 30 which is supplied through the nozzle 40*b*. This makes it possible to quantify a supplied amount of the molten metal 30 strictly to some extent.

[Concrete Configuration Example of Ladle]

Figure 14:
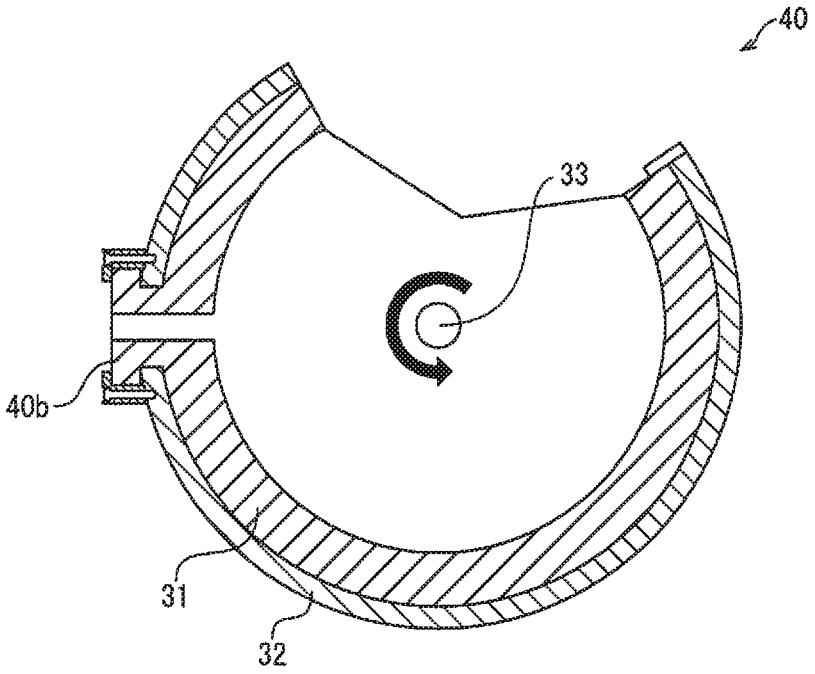
FIG. 14 is a cross-sectional view illustrating a concrete configuration example of an arc ladle in accordance with the present invention.

FIG. 14 is a cross-sectional view illustrating a concrete configuration example of the arc ladle 40.

As illustrated in FIG. 14, the arc ladle 40 includes (i) a ladle wall 31 constituting an inner wall of the ladle body 40*a*, (ii) a shell 32 which covers the ladle wall 31 and constitutes an outer wall of the ladle body 40*a*, (iii) a swinging shaft 33 which is provided at the center 40*c* and extends in the front-back direction of the sheet on which FIG. 14 is illustrated, and (iv) the nozzle 40*b*.

For example, a radius (corresponding to a radius of the circle ca) of the outer wall of the ladle body 40*a* illustrated in FIGS. 11 and 16 is 250 mm, a width (corresponding to a width of the bottom surface portion 40*d* in a direction along the swinging shaft) of the ladle body 40*a* is 150 mm, and a length of the nozzle 40*b* is 110 mm.

[Additional Remarks]

Each of the casting machines 100 and 110 is provided with the nozzle 40*b* as a pouring gate. Note, however, that the pouring gate is not limited to the nozzle 40*b* having a cylindrical shape, and can be in a form of a circular cone shape, a prismatic shape, or the like. The pouring gate can be formed by a method in which, for example, the bottom surface portion 40*d* of the ladle body 40*a* is cut out.

[Main Points]

In order to attain the object, the casting mold supporting structure includes: a support roller for supporting a part of a casting mold that is used in centrifugal casting, the casting mold has a supported surface at which the casting mold is supported by the support roller, the supported surface being inclined with respect to a rotation axis of the casting mold.

According to the configuration, the supported surface at which the casting mold is supported by the support roller is inclined with respect to the rotation axis of the casting mold. From this, the casting mold is supported by the support roller in the rotation axis direction and in a direction perpendicular to the rotation axis. This makes it possible to more firmly support the casting mold, and it is therefore possible to inhibit vibration during rotation of the casting mold. This allows high speed rotation of the casting mold.

In the casting mold supporting structure of the present invention, it is preferable that the supported surface is inclined with respect to the rotation axis of the casting mold so that force for pressing the part of the casting mold by the support roller is directed to a center part of the casting mold in a rotation axis direction of the casting mold.

In a case where the supported surface is inclined with respect to the rotation axis of the casting mold so that force for pressing the part of the casting mold by the support roller is directed to an outer side of the casting mold, it is necessary to additionally provide a mechanism for moving the support roller in a direction perpendicular to the supported surface of the casting mold.

However, according to the configuration of the present invention, it is possible to support the casting mold merely by causing the support roller to make contact with the part of the casting mold. It is therefore possible to simplify a mechanism of the casting machine including the casting mold supporting structure of the present invention. This makes it possible to reduce the number of constituent members and to reduce cost.

In the casting mold supporting structure of the present invention, it is preferable that the support roller supports a part of the casting mold, the part having a circular truncated cone shape whose central axis conforms to the rotation axis of the casting mold.

According to the configuration, the part of the casting mold which part is supported by the support roller has the circular truncated cone shape. This makes it possible to apply force to the part in the rotation axis direction of the casting mold and in a direction perpendicular to the rotation axis direction. From this, it is possible to more firmly support the casting mold, and this allows high speed rotation of the casting mold.

In the casting mold supporting structure of the present invention, it is preferable that the part having the circular truncated cone shape has the supported surface at which the casting mold is supported by the support roller, the supported surface of the part being inclined with respect to the rotation axis of the casting mold at an angle of 10° or more and 50° or less.

According to the configuration, pressing force by the support roller is appropriately applied to the supported surface of the part having the circular truncated cone shape in the rotation axis direction of the casting mold and in the direction perpendicular to the rotation axis direction. It is therefore possible to more stably support the casting mold, and accordingly to carry out high speed rotation of the casting mold more safely.

In the casting mold supporting structure of the present invention, it is preferable that the part of the casting mold is supported by at least three support rollers each of which is the above support roller.

According to the configuration, loads are applied to at least three positions on each of the parts having the circular truncated cone shape, and therefore the casting mold is supported more stably. It is therefore possible to carry out high speed rotation of the casting mold more safely.

In the casting mold supporting structure of the present invention, it is preferable that, when an end surface of the casting mold is viewed in the rotation axis direction of the casting mold, the at least three support rollers are arranged so that angles become uniform each of which is formed by (i) a line connecting the rotation axis with one of adjacent two of the at least three support rollers and (ii) a line connecting the rotation axis with the other of the adjacent two of the at least three support rollers.

According to the configuration, the at least three support rollers are arranged on the end portion which is of the casting mold and has the circular truncated cone shape so that angles become uniform each of which is formed by (i) a line connecting the rotation axis with one of adjacent two of the at least three support rollers and (ii) a line connecting the rotation axis with the other of the adjacent two of the at least three support rollers (when the casting mold is viewed along the rotation axis). By thus arranging the at least three support rollers, force is uniformly applied to the end portion, and therefore the casting mold can be more stably supported. This makes it possible to more safely carry out high speed rotation of the casting mold.

In the casting mold supporting structure of the present invention, it is preferable that the support roller has an outer shape of a circular truncated cone; and an upper base surface of the circular truncated cone faces an outer side of the casting mold.

According to the configuration, it is possible to disperse reaction force applied to the support roller in different directions which reaction force is caused by supporting the part having the circular truncated cone shape by the support roller. It is therefore possible to inhibit breakage of the support roller, and to safely rotate the casting mold at a high speed.

Moreover, according to the configuration, the rotation axis of the casting mold, the rotation axis of the support roller, and an extended line that is extended to the outer side from the supported surface intersect with each other at a particular point on the rotation axis of the casting mold. Therefore, it is possible to prevent a difference in rotation caused between portions constituting the support roller. This makes it possible to inhibit, during centrifugal casting, slippage of the support roller in the rotation axis direction of the casting mold and slippage of the support roller in the direction perpendicular to the rotation axis of the casting mold.

In the casting mold supporting structure of the present invention, it is preferable that the support roller is movable in a direction along the rotation axis of the casting mold.

According to the configuration, it is possible to release the support of the casting mold merely by moving the support roller in the rotation axis direction of the casting mold, and it is therefore possible to easily replace the casting mold.

The casting machine of the present invention includes the above described casting mold supporting structure.

According to the configuration, it is possible to provide the casting machine which can (i) inhibit vibration of the casting mold and (ii) surely support the casting mold, even in a case where the casting mold is rotated at a high speed.

The method of the present invention for producing a cast product is a method for producing a cast product with use of the above described casting machine and includes the step of: rotating the casting mold containing molten metal while supporting the part of the casting mold by the support roller in the casting mold supporting structure that is provided in the casting machine.

According to the configuration, the casting machine of the present invention is used, and it is therefore possible to rotate the casting mold at a high speed while inhibiting vibration of the casting mold during rotation. This makes it possible to evenly distribute the molten metal on the inner surface of the casting mold, and it is therefore possible to produce a cast product having a uniform thickness. From this, it is possible to improve quality of a cast product by the method of the present invention for producing a cast product.

The casting mold of the present invention is a casting mold for use in centrifugal casting, the casting mold having a side surface in a longitudinal direction at which side surface the casting mold that is being rotated during centrifugal casting is supported by a plurality of support rollers, each of the plurality of support rollers having a rotation axis that is inclined with respect to a rotation axis of the casting mold.

According to the configuration, the side surface of the casting mold in the longitudinal direction is provided so that the rotation axis of each of the support rollers is inclined with respect to the rotation axis of the casting mold. Therefore, the casting mold is supported by the support rollers in the rotation axis direction of the casting mold and in the direction perpendicular to the rotation axis. This makes it possible to more firmly support the casting mold, and to inhibit vibration of the casting mold during rotation. It is therefore possible to provide the casting mold that can be rotated at a high speed.

The casting mold of the present invention has end portions which are provided at both ends of the casting mold and each of which has a circular truncated cone shape whose central axis conforms to the rotation axis of the casting mold, the casting mold being supported by the plurality of support rollers at the end portions.

According to the configuration, each of the end portions of the casting mold has the circular truncated cone shape, and therefore vibration during rotation is inhibited by supporting the end portions by the support rollers. Moreover, in a case where the end portions are supported by the support rollers, it is possible to apply force to the end portions in the rotation axis direction of the casting mold and in the direction perpendicular to the rotation axis direction, and it is therefore possible to more firmly support the casting mold. From these, it is possible to provide the casting mold that can be rotated at a high speed.

The molten metal supplying structure of the present invention includes: a ladle; and a chute that has a groove for receiving molten metal supplied from the ladle and guiding, in a horizontal direction, the molten metal thus received, the ladle having (i) a ladle body for retaining the molten metal and (ii) a pouring gate via which the molten metal retained in the ladle body is supplied to an outside, the ladle body having (i) a swinging shaft for swinging the pouring gate in a plane that is defined by a direction in which the molten metal is supplied from the ladle body to the outside and a vertical direction and (ii) a bottom surface portion (a) whose cross sectional shape taken in a direction parallel to the plane forms a first arc centered on the swinging shaft and (b) which extends along the swinging shaft, and the pouring gate being provided in the bottom surface portion.

According to the configuration, a position of the pouring gate can be changed by swinging the ladle body. This makes it possible to appropriately change, in accordance with a swing angle of the ladle body, a position at which the chute receives the molten metal. Consequently, it is possible to inhibit seizing caused on a surface of the chute without thickly applying a mold wash to the surface of the chute which surface makes contact with the molten metal. This allows reduction in damage on the chute.

In the molten metal supplying structure of the present invention, it is preferable that, in a cross section in parallel with the plane, an angle between (i) the direction in which the molten metal is supplied from the ladle body to the outside and (ii) a direction in which the chute guides the molten metal is 90° or more and 270° or less.

According to the configuration, the flow direction of the molten metal supplied from the ladle is greatly changed by the chute. It is therefore possible to buffer a flow speed of the molten metal supplied from the ladle. This makes it possible to stabilize the flow of the molten metal supplied from the chute.

In the molten metal supplying structure of the present invention, it is preferable that a cross sectional shape of the chute taken in the direction in parallel with the plane forms a second arc centered on the swinging shaft, a distance between the swinging shaft and the second arc being greater than a distance between the swinging shaft and the first arc.

According to the configuration, it is easy to set a shortest distance between the bottom surface portion (or the pouring gate) and the chute to be constant. By setting the shortest distance to be constant, it is possible to further stabilize the guiding of the molten metal by the chute.

In the molten metal supplying structure of the present invention, it is preferable that a width of the bottom surface portion along the swinging shaft is smaller than a diameter of a circle having the first arc.

According to the configuration, by thus making smaller the width of the ladle body in the direction perpendicular to the direction in which the molten metal is supplied via the pouring gate, it is possible to easily control an amount of the molten metal to be supplied.

In the molten metal supplying structure of the present invention, it is preferable that the pouring gate is configured by a nozzle having a substantially cylindrical shape; and in the cross section in parallel with the plane, a shaft center of the nozzle is located on a line connecting the swinging shaft and a center of the nozzle.

According to the configuration, the shaft center of the nozzle is located on the line connecting the swinging shaft and the center of the nozzle in the cross section. This makes it possible to smoothen the flow of the molten metal that passes through the nozzle.

The casting machine of the present invention includes the above described molten metal supplying structure.

According to the configuration, it is possible to bring about, in the casting machine, an effect similar to that of the molten metal supplying structure.

The method of the present invention for producing a cast product is a method for producing a cast product with use of the above described casting machine, the method including the step of: supplying molten metal to a mold in the casting machine from the ladle via the chute, the mold having a cylindrical shape, during the step of supplying molten metal, a part via which the molten metal is supplied to the mold being moved toward the chute while the mold is rotated around a cylindrical axis of the mold.

According to the configuration, the casting machine of the present invention is used, and it is therefore possible to produce a cast product in which deterioration in quality is inhibited.

The present invention is not limited to the embodiments, but can be altered by a skilled person in the art within the scope of the claims. An embodiment derived from a proper combination of technical means each disclosed in a different embodiment is also encompassed in the technical scope of the present invention. Further, it is possible to form a new technical feature by combining the technical means disclosed in the respective embodiments.

INDUSTRIAL APPLICABILITY

The present invention is applicable to (i) a casting mold supporting structure that enables high speed rotation of a casting mold, (ii) a casting machine including the casting mold supporting structure, (iii) a method for producing a cast product with use of the casting machine, (iv) a casting mold, and (v) a molten metal supplying structure including a ladle for supplying molten metal to an outside.

REFERENCE SIGNS LIST

1, 200, 300, 400, 500: Casting mold
1*a*: Mold
1*b*: Sleeve
1*c*: Casting mold supporting structure
1*d*: End surface
1*e*, 300*a*: End portion (part which is of casting mold and is formed in a circular truncated cone shape)
1*f*: Space
1*g*: Side surface of the end portion (supported surface supported by support roller)
2, 600, 700: Support roller
2*c*: Upper base surface
7: Vibration damping base
10: Cast product forming section
20: Fixed ladle
30: Molten metal
31: Ladle wall

32: Shell
33: Swinging shaft
40: Arc ladle (ladle)
40*a*: Ladle body
40*b*: Nozzle
40*c*: Center of first arc (swinging shaft)
40*d*: Bottom surface portion
40*ax*: Shaft center of nozzle
40*e*: Center of nozzle
50: Motor
60: Chute
70: Trough
80: Trough move section
100, 110: Casting machine
200*a*, 400*a*, 500*a*: Support section (part of casting mold, a part which is of the casting mold and is formed in a circular truncated cone shape)
C1, C3, C4: Rotation axis (rotation axis of casting mold)

The invention claimed is:

1. A molten metal supplying structure comprising:
a ladle; and
a chute that has a groove for receiving molten metal supplied from the ladle and guiding, in a horizontal direction, the molten metal thus received,
the ladle having (i) a ladle body for retaining the molten metal and (ii) a pouring gate via which the molten metal retained in the ladle body is supplied to an outside,
the ladle body having (i) a swinging shaft for swinging the pouring gate in a plane that is defined by a direction in which the molten metal is supplied from the ladle body to the outside and a vertical direction and (ii) a bottom surface portion (a) whose cross sectional shape taken in a direction parallel to the plane forms a first arc centered on the swinging shaft and (b) which extends along the swinging shaft, and
the pouring gate being provided in the bottom surface portion,
wherein a cross sectional shape of the chute taken in the direction in parallel with the plane forms a second arc centered on the swinging shaft, a distance between the swinging shaft and the second arc being greater than a distance between the swinging shaft and the first arc.

2. The molten metal supplying structure as set forth in claim 1, wherein:
in a cross section in parallel with the plane, an angle between (i) the direction in which the molten metal is supplied from the ladle body to the outside and (ii) a direction in which the chute guides the molten metal is 90° or more and 180° or less.

3. The molten metal supplying structure as set forth in claim 1, wherein:
a width of the bottom surface portion along the swinging shaft is smaller than a diameter of a circle having the first arc.

4. The molten metal supplying structure as set forth in claim 1, wherein:
the pouring gate is configured by a nozzle having a substantially cylindrical shape; and
in the cross section in parallel with the plane, a shaft center of the nozzle is located on a line connecting the swinging shaft and a center of the nozzle.

5. A casting machine comprising a molten metal supplying structure recited in claim 1.

6. A method for producing a cast product, said method comprising the step of: using a casting machine recited in claim 5;
supplying molten metal to a mold in the casting machine from the ladle via the chute, the mold having a cylindrical shape,
during the step of supplying molten metal, a part via which the molten metal is supplied to the mold being moved toward the chute while the mold is rotated around a cylindrical axis of the mold.

7. A molten metal supplying structure comprising:
a ladle;
a chute that has a groove for receiving molten metal supplied from the ladle and guiding, in a horizontal direction, the molten metal thus received; and
a motor directly attached to the ladle,
the ladle having (i) a ladle body for retaining the molten metal and (ii) a pouring gate via which the molten metal retained in the ladle body is supplied to an outside,
the ladle body having (i) a swinging shaft for swinging the pouring gate in a plane that is defined by a direction in which the molten metal is supplied from the ladle body to the outside and a vertical direction and (ii) a bottom surface portion (a) whose cross sectional shape taken in a direction parallel to the plane forms a first arc centered on the swinging shaft and (b) which extends along the swinging shaft, and
the pouring gate being provided in the bottom surface portion.

* * * * *